United States Patent [19]

Cook

[11] Patent Number: 5,007,174

[45] Date of Patent: Apr. 16, 1991

[54] TOPOGRAPHIC MEASURING DEVICE

[76] Inventor: Robert J. Cook, 316 W. Prospect, Apt. 209, Fort Collins, Colo. 80526

[21] Appl. No.: 468,233

[22] Filed: Jan. 22, 1990

[51] Int. Cl.[5] ..... B43L 7/10

[52] U.S. Cl. ..... 33/1 SD; 33/465; 33/431; 33/471

[58] Field of Search ..... 33/1 SD, 431, 452, 457, 33/465, 471, 472, 494, 491

[56] References Cited

U.S. PATENT DOCUMENTS

| | | | |
|---|---|---|---|
| 932,907 | 8/1909 | Rydman | 33/457 |
| 977,048 | 11/1910 | Smith | 33/431 |
| 1,299,978 | 4/1919 | MacDowney | 33/471 |
| 2,238,190 | 4/1941 | Sawtelle | 33/457 |
| 2,641,843 | 6/1953 | Hart et al. | 33/431 |
| 3,248,793 | 5/1966 | Anderson | 33/431 |
| 3,280,464 | 10/1966 | Warner | 33/431 |
| 3,303,568 | 2/1967 | Geiger | 33/457 |
| 3,813,783 | 6/1974 | Price | 33/1 SD |
| 3,855,706 | 12/1974 | Price | 33/431 |
| 4,383,372 | 5/1983 | Zane et al. | 33/1 SD |

FOREIGN PATENT DOCUMENTS

| | | | |
|---|---|---|---|
| 10740 | 9/1909 | France | 33/471 |

OTHER PUBLICATIONS

Aerial Photo Scale Protractor.

Drawing and Drafting Catalog, p. 147 and enlargement.

*Primary Examiner*—Thomas B. Will

*Attorney, Agent, or Firm*—Fields, Lewis, Pittenger & Rost

[57] ABSTRACT

A measuring device for topographic sheets includes top and bottom transparent arms that pivot relative to a connecting pivot. A plurality of different distance scales on each arm provide for measuring the distance between two points on a topographic sheet. A protractor on the top arm and pointer marks on the bottom arm provide an indication of the extent of rotation of one arm relative to the other. The device is suitable for measuring distance between points, azimuth, scale and position of true north on an aerial photo. A slidable cross-hair member is used on either arm. One embodiment has a protractor affixed to the top arm and another has the protractor rotatable and removable from the top arm. A third embodiment has the bottom arm offset from the center of the protractor and the bottom arm slidable relative to the top arm.

28 Claims, 3 Drawing Sheets

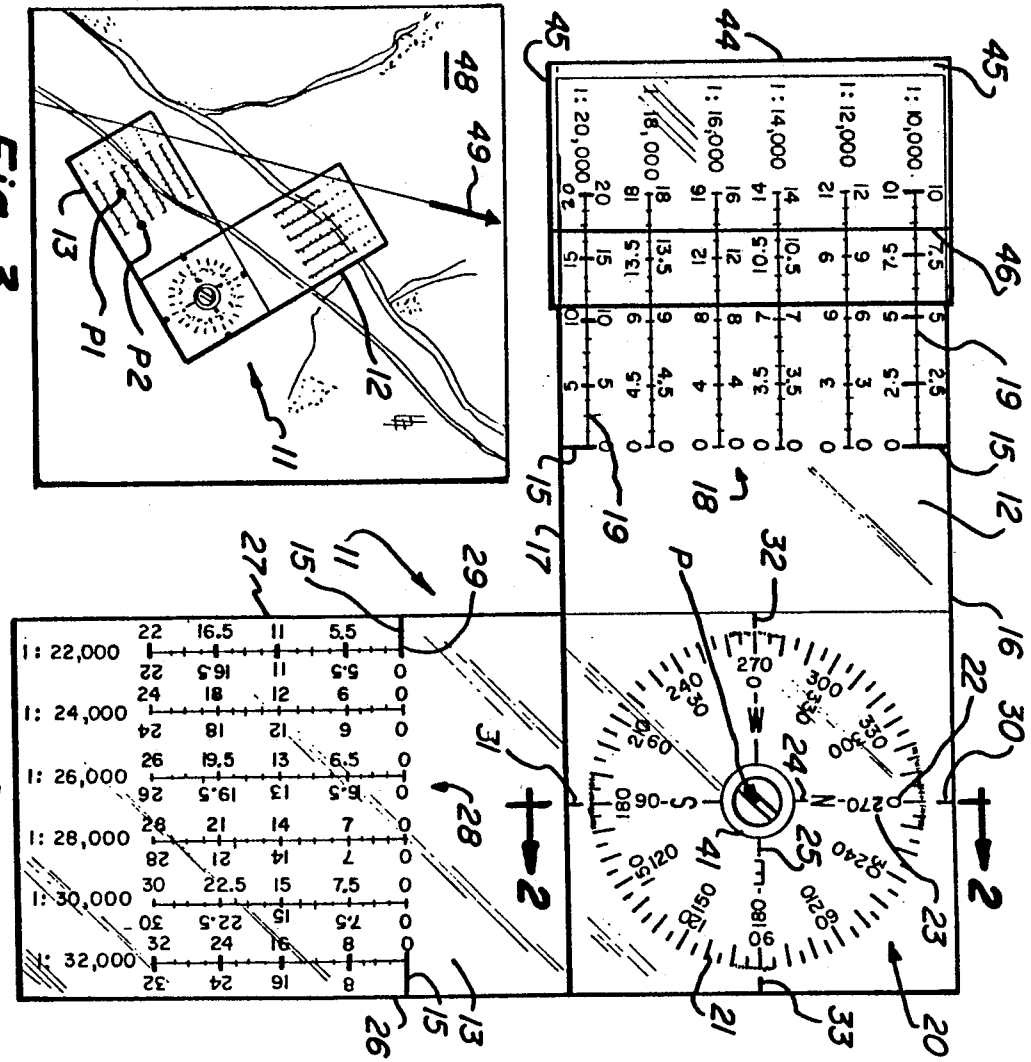
Fig_1
Fig_3
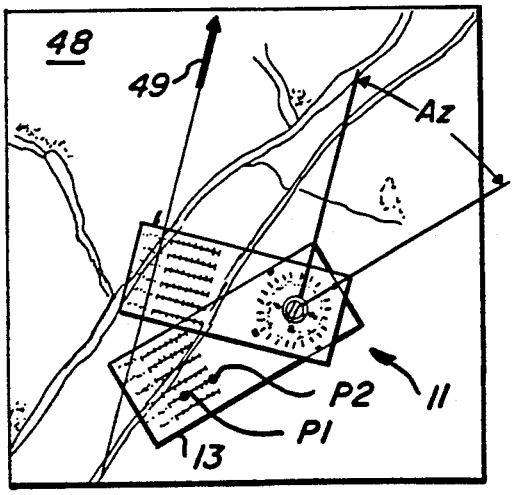
Fig_4
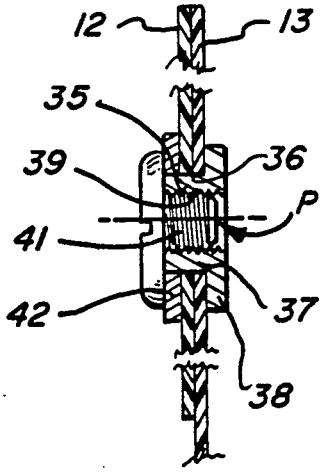
Fig_2

TOPOGRAPHIC MEASURING DEVICE

TECHNICAL FIELD

This invention relates to a novel and improved measuring device that is particularly suitable for use with aerial photos, topographic maps and the like.

BACKGROUND ART

Aerial photographs, topographic maps and the like frequently require the finding of information such as the distance and azimuth between selected points, scale, and the position of true north.

A commonly used measuring device suitable for this purpose is identified as an Aerial Photo Scale-Protractor. This device is a single, elongated, rectangular, transparent sheet having a protractor at one end with a North indicia at 0, cross hairs at 0 and 90 degree intervals corresponding to east, west and south and with scale numbers from 0 to 180 in both directions from 0. A plurality of different distance scales are arranged along the sheet. The procedure for using this device is to center the cross hairs on a first point, locate the N-S axis parallel to a reference line (true north), place a straight edge to intersect the two points, read the angle on the protractor scale, and measure the distance between the two points on the distance scale. Several disadvantages of this device are that:

The user must simultaneously keep the cross hairs centered over a first point, keep the north-south axis parallel to the reference line (true north), and arrange a straight edge so that it passes through both points to find the azimuth. The alignment with the reference line (true north) is typically done by a visual alignment regardless of the distance separating the north-south axis from the reference line. The distance between the points must be found in a separate step, during which all of the above alignment is negated.

This procedure must be repeated between every two points, i.e. between points one and two, two and three, etc. If the position of true north, or the scale of the photo is unknown, it is very difficult or impossible to use this device. In summary, this device is somewhat tedious to use, has great potential for inaccuracy, is impractical and is essentially useless without knowing the position of true north and/or the scale of the aerial photo.

A more general prior art drawing and drafting tool sold as the CRAYOLA ® measure maker is comprised of two opaque, rigid arms that are pivotally connected together and with a protractor arranged for indicating the relative angular position between the two arms. This device is not specifically adapted to measure and plot the above discussed parameters on topographic maps and aerial photos.

DISCLOSURE OF THE INVENTION

A measuring device for topographic sheets disclosed has transparent top and bottom arms pivotally connected at a pivot. Each of the arms has a plurality of different distance scales to provide for the measurement between two selected points on a topographic sheet. In one embodiment a protractor on the top arm is centered at the pivot. An arrangement of pointer marks on the bottom arm associated with graduation lines of the protractor provide a measure of the angle of deviation of a line intersecting two selected points from a reference line on the topographic sheet.

In the one embodiment disclosed the protractor is stationary on the top arm; in another embodiment the protractor rotates relative to the top arm and is removable for changing scales; and in yet a third embodiment a third support arm is added to dispose the longitudinal center line of the bottom arm to a position that is offset from the center of the protractor and also enables the bottom arm to slide relative to the top arm.

BRIEF DESCRIPTION OF THE DRAWINGS

Details of this invention are described in connection with the accompanying drawings which like parts bear similar reference numerals in which:

FIG. 1 is a top plan view of a topographic measuring device embodying features of the present invention.

FIG. 2 is a sectional view taken along line 2—2 of FIG. 1.

FIG. 3 is a top plan view of an illustration of the operation of the device wherein a selected distance scale on the bottom arm intersects points P1 and P2 on an aerial photo.

FIG. 4 is a top plan view of the device in FIG. 1 wherein the top arm has been rotated so that its graduation lines are parallel to true north to provide an azimuth reading for a line intersecting points P1 and P2.

DETAILED DESCRIPTION

Figure 5:
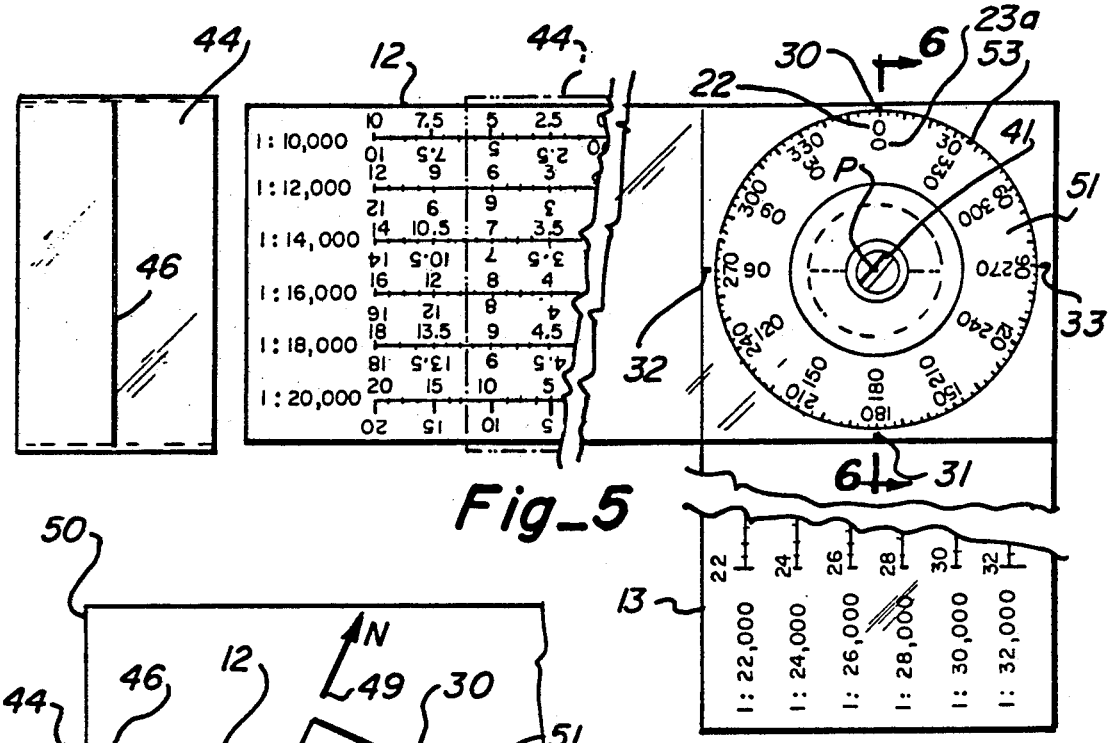
FIG. 5 is a top plan view of another embodiment of a topographic measuring device embodying features of the present invention using a rotatable protractor.

Referring now to FIGS. 1–4 there is shown a measuring device 11 embodying features of the present invention which in general includes a top arm 12 and a bottom arm 13 pivotally connected together to pivot about a pivot P. As shown the top arm 12 and bottom arm 13 are disposed at right angles to one another.

The top arm 12 shown is in the form of an elongated, thin, flat, rectangular, transparent sheet, preferably a flexible or pliable thin sheet plastic, having a pair of oppositely disposed straight longitudinal edges 16 and 17. The top arm further has a plurality of different distance scales 18 which extend along the arm. There are 5 distance scales shown on the top arm. Each of these distance scales is parallel to the longitudinal edges 16 and 17, and has a series of graduation lines 19 extending perpendicular to the longitudinal edges and each scale has the appropriate numerical indicia indicating the numerical value of selected of the graduation lines on the scale and also indicating the scale such as 1:10,000.

The numerical indicia shown for four positions on this scale with the top arm oriented in a horizontal position proceeding from left to right are 0, 2.5, 5, 7.5 and 10 and progress away from the protractor 20. Preferably, there are two sets of numerical indicia for each distance scale with one being inverted relative to the other to enable the user to turn the arm upside down and still read the distance scale directly. The graduation lines of the different scales are in alignment such as the halfway graduations having numerical indicia 5, 6, 7, 8, 9 and 10 on the top arm. The 0 graduation lines and 0's are in alignment, and the 0 graduation lines of the top and bottom scales extend to the longitudinal edges of each arm and are herein after referred to as the plotting marks 15. The aligned graduation lines provide a straight line-visual guide that is aligned with the reference line (true north). In addition, regularly spaced graduation lines of the top and bottom scales are aligned, and are longer or of a different color than those of the intermediate scales to provide a longer line to sight along for aligning with the reference line. Furthermore, when these graduation lines are aligned equidistant from the reference line, the arm on which they are printed is perpendicular to the reference line.

The top arm 12 has a protractor 20 with its center located at the pivot P and at the longitudinal center line of the top arm 12. The protractor shown has the usual equally spaced and circumferentially arranged protractor graduation lines 21 extending radially from a selected distance from its center. While only a few of the graduation lines are shown in the drawing because of space limitations it is understood that preferably there would be a graduation line for each degree as is done with conventional protractors. An outer scale 22 has associated numerical indicia proceeding from 0 to 360 in selected increments extending in a clockwise direction. The 0 is located at the top when the top arm is oriented in a horizontal position and the distance scales extend to the left away from the protractor as shown in FIG. 1. The numerical indicia for the outer scale 22 are arranged to extend circumferentially. The numerical indicia shown is in increments of 30 because of space limitations but it is understood that in practice additional indicia would be added such as every 5 or 10 degrees.

An inner scale 23 has associated numerical indicia extending from 0 to 360 in selected increments in a counterclockwise direction. The 0 begins on the left side on the top arm as shown which corresponds to the 270 degree position with respect to the outer scale. The numerical indicia for the inner scale are arranged to extend radially. However, the numerical indicia of both scales could be arranged radially and equidistantly from the protractor center. The protractor shown has a north-south axis 24 of the outer scale arranged perpendicular to the longitudinal edges 16 and 17 and an east-west axis 25 arranged parallel to the longitudinal edges and intersecting the north-south axis 24 at the pivot P and at the longitudinal center line of the top arm.

The bottom arm 13 is also in the form of an elongated, thin, flat, rectangular, transparent sheet, preferably a flexible or pliable thin sheet plastic, having a pair of oppositely disposed straight longitudinal edges 26 and 27. The bottom arm has a plurality of different distance scales 28 which extend along the arm. There are 5 distance scales shown on the bottom arm. Each of the distance scales on the bottom arm has a series of graduation lines 29 extending perpendicular to the longitudinal edges and each has numerical indicia identifying the scale as for example 1:22,000. It is noted the distance scales on the bottom arm differ from those on the top arm and together they provide a range of ratios from 1:10,000 to 1:30,000 in increments of 2,000 between each distance scale.

The bottom arm 13 further has a first pointer mark 30 located on the longitudinal center line of the bottom arm at one end thereof so that when the bottom arm 13 is at right angles to the top arm 12 as shown in FIG. 1 this mark is lined up with the 0 on the outer scale. The bottom arm has a second pointer mark 31 located on the longitudinal center line of the bottom arm opposite the first pointer mark and lined up with the 180 on the outer scale when the bottom arm is at right angles to the top arm. This second pointer mark 31 would align with the 0 on the outer scale if the bottom arm were rotated 180 degrees with respect to the position shown in FIG. 1. The lines 30 and 31 provide a pointer means on the bottom arm that is offset 90 degrees on the bottom arm with respect to the orientation of the protractor line with 0 to 180 indicia when the top and bottom arms are superposed on one another. Both pointer marks 30 and 31 then are primarily associated with the outer scale 22 and in practice the scale numbers and the pointer marks would bear the same color, preferably red. The ability to reverse the bottom arm to a 180 degree position affords positioning of the graduation lines on the top arm closer to the reference line.

The bottom arm 13 has a third pointer mark 32 located along one longitudinal edge and a fourth pointer mark 33 located on the opposite edge. These pointer marks are on a line perpendicular to a line through the first and second pointer marks and are primarily associated with the inner scale 23 and in practice the inner scale numbers and pointer marks 32 and 33 would bear the same distinctive color, preferably black.

The two scales 22 and 23 and their associated pointer marks are related to the interchangeable functions of the two arms. In general, the inner (counterclockwise) scale 23, and its associated pointer marks 32 and 33, is used when the distance scale graduations, etc. of the bottom arm are used to align with the reference line, while a distance scale on the top arm is used to measure the distance between points. Conversely, the outer (clockwise) scale 22 (and pointer marks 30 and 31) is used when the distance scale graduations, etc. of the top arm are used to align with the reference line, while a distance scale on the bottom arm is used to measure the distance between points.

The pivotal connection for the top and bottom arms shown is provided by having a pair of aligned holes 35 and 36 in the top and bottom arms, respectively, together with a screw post 37 that is inserted into the holes from below. The screw post 37 has a flat head 38 and internal threads 39. A flat-headed screw 41 that carries a washer 42 is threaded into the screw post 37 from above.

A slidable cross-hair member 44 is also shown in FIG. 1. Member 44 is transparent and slides over the top arm and has a pair of oppositely disposed flanged end portions 45 that cup over and slide along the longitudinal edges of the top arm to hold member 44 for guided sliding movement on either arm. A cross-hair 46 on member 44 extends parallel to the distance graduation lines 19 and provides a longer continuous line to align with a reference line or edge of the topographic sheet.

The operation or manner of using the above described measuring device 11 will first be explained in connection with measuring the distance between two points and finding the azimuth of a line intersecting these points on a topographic sheet. The term topographic sheet as used herein is intended to be a generic term for both aerial photographs, topographic maps and the like.

Referring now to the illustrations in FIGS. 3 and 4, an appropriate distance scale for an aerial photograph 48 being measured is found which for this example corresponds with the distance scale on the bottom arm 13. The top arm 12 is shown perpendicular to the bottom arm so that the 0 on the outer scale 22 is in line with pointer mark 30 on the bottom arm as is seen in FIG. 1. The bottom arm 13 is shown positioned so that both of the points designated P1 and P2 intersect the distance scale for that topographic sheet and this then provides a measure of distance between two selected points P1 and P2 (FIG. 3). The top arm 12 is then rotated about the pivot P until the distance graduation lies 19 (or the cross-hair 46) are parallel to the reference line 49 (true north). The angle of rotation of the top arm 12 relative to the bottom arm 13 is read on the outer scale 22 using the pointer mark 30. The longitudinal edges 16 and 17 and the distance scales, which are perpendicular to the distance scale graduation lines, may also be used to align with the reference line. In this case, arm 12 would be turned 90 degrees from that shown in FIG. 4 and pointer marks 32 or 33, which are perpendicular to the set of pointer marks 30 and 31, would then be used to show the angle of rotation on the outer scale. The term "selected line" as used herein refers to either the distance scales or cross-hair in one situation or the longitudinal edges or distance scales in the other situation. In the illustration shown this angle of rotation is designated AZ and is 46 degrees. It is noted this is also the angle formed by the distance scale with the reference line 49 and further is the angle between the longitudinal edge 27 of the bottom arm 13 and the reference line 49.

In order to use the above described measuring device to plot points on an aerial photo, the measuring device is placed on an aerial photo, the top arm 12 is rotated until the desired angle (a given) to the next point is shown. The proper distance scale is selected. Then without moving the top arm 12 the entire device is rotated so that a plotting mark on the bottom arm intersects the first point P1 and so that the graduation lines on the top arm are parallel to the reference line (true north). Once the device is rotated, then the cross-hair member 44 is slid an appropriate distance and point 2 is marked along the edge of the bottom arm at the end of the cross-hair 46. A second cross-hair member 44 may be associated with the top arm.

For finding the position of true north on an aerial photo using the above described device, a topographic map is used which covers the same land area. Two points on the topographic map are selected which are readily located on the aerial photo. The true north arrow, typically found drawn on the bottom margin of every topographic map, is extended. Then, the longitudinal edge 27 of the bottom arm 13 is used to intersect the two points P1 and P2 on the topographic map. The top arm 12 is moved until the distance graduations are parallel to the extended north line or to the edge of the topographic map. The angle or azimuth is read on the outer scale 22. Finally, use an edge of the bottom arm to intersect the same two points on the photo and move the top arm 12 until the same angle is noted. True north is parallel to the graduations on the top arm and to a line drawn through any of a pair of plotting marks on the top arm 12.

For finding the scale of an aerial photograph using the above described device, a topographic map which covers the same land area is again used and two points are selected on the map which are obvious on the aerial photograph. The distance between two points is measured on the map using one of the arms and the appropriate distance scale. A plotting mark is placed over one of the points on the aerial photograph and the sliding cross-hair is moved until it intersects the other point. The user looks along the length of the cross-hair and note where the cross-hair intersects a distance equal to that found on the topographic map. The proportion (e.g. 1:20000) of the distance scale on which the matching distance is found is also the proportion (scale) of the photo.

Figure 6:
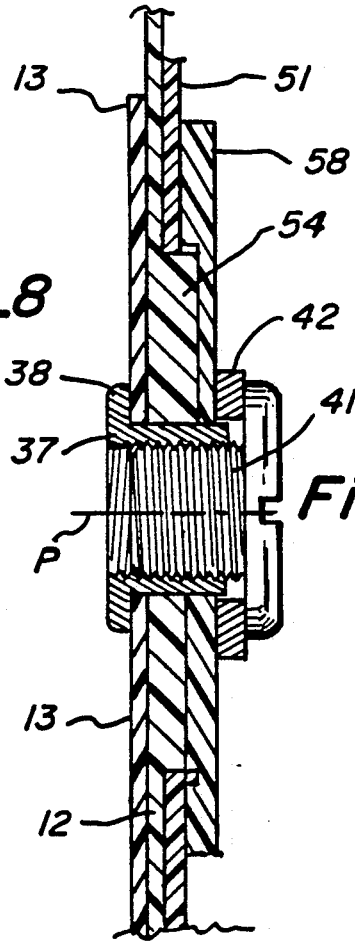
FIG. 6 is a sectional view taken along line 6—6 of FIG. 5.
Figure 7:
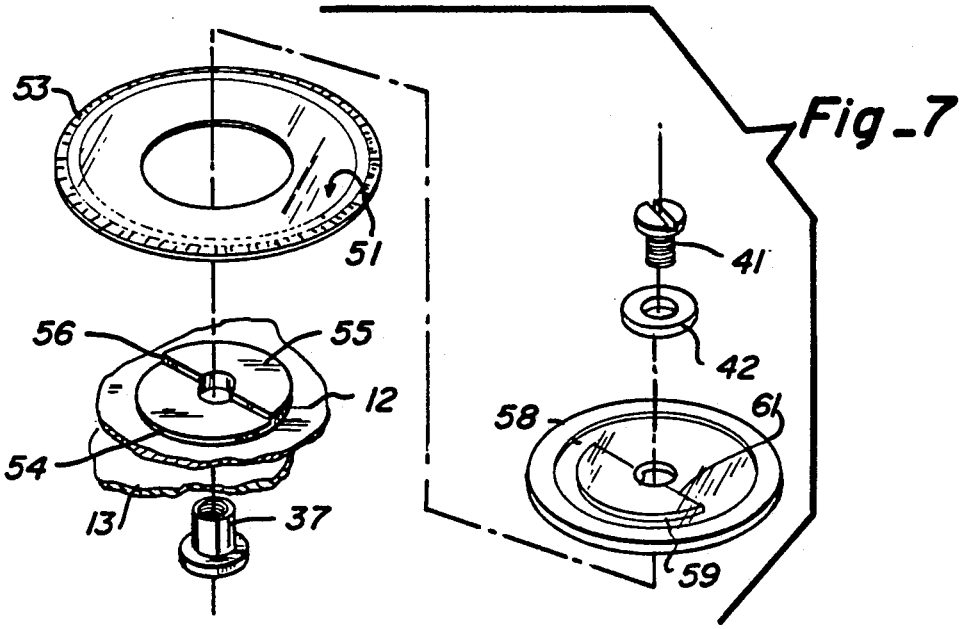
FIG. 7 is an exploded view of the assembly shown in FIGS. 5 and 6.

Referring now to FIGS. 5–8 there is shown another embodiment of a measuring device which includes the top arm 12 and a bottom arm 13 connected to pivot at a pivot P. This embodiment has a protractor 51 formed on a thin flat ring that is removable from the top arm. This protractor 51 has graduation lines 53 similar to lines 21 above described. The outer scale 22 has the numerical indicia arranged like that of FIG. 1. The inner scale **23*a* differs in that the 0 is at the top rather than on the left side but is similar in that the numbers progress in a counterclockwise direction. The protractor 51 is concentric with and rotates about a circular hub 54 affixed to the top arm 12 so that the protractor 51 will rotate about pivot P relative to the top arm. As best seen in FIGS. 6 and 7 the hub 54 on top arm 12 has a raised circular half-section 55 with a diametral edge 56. A circular flat washer 58 fits on the top of the ring and has a depending circular half-section 59 with a diametral edge 61. The abutting diametrical edges 56 and 61 of the two half-sections 55 and 59 engage one another to prevent the protractor 51** from rotating when the bottom arm is rotated relative to the top arm. An advantage of having a protractor separate from the top arm is that it is readily removed and replaced with a different scale such as a surveyor's scale that proceeds from 0° to 90° in each of four quadrants of a 360 degree scale.

Azimuth as used herein is generally defined as the number of degrees from 0–360, clockwise, from true north one point is from another point. Bearings are expressed as the number of degrees from 0–90, clockwise, or counterclockwise, from true north or south as the reference directions. It is understood that the degree scale could be either of the azimuth or quadrant (for bearings) type.

The embodiment of FIGS. 5–8 may be operated in the same manner as that shown in FIGS. 1–4 above described but in addition may be operated or used so that the edge of the aerial photo is the reference. In the first use the two arms 12 and 13 are initially superposed on one another and the rotatable protractor 51 is moved so that the pointer mark 30 on the bottom arm 13 is on the 0 of the outer scale of the top arm. Then the device is ready to use in the same manner as with the first embodiment. When the edge of the aerial photograph is used as a reference line instead of true north the angle between the edge and true north must be accounted for. There are two options. One option is to subtract this angle from the total angle between the edge and the line intersecting the two points. The other option is to adjust or calibrate the measuring device so that the angle between true north and the photo edge is automatically compensated for. The ability to rotate the protractor 51 relative to the top arm provides for such a calibration.

Figure 8:
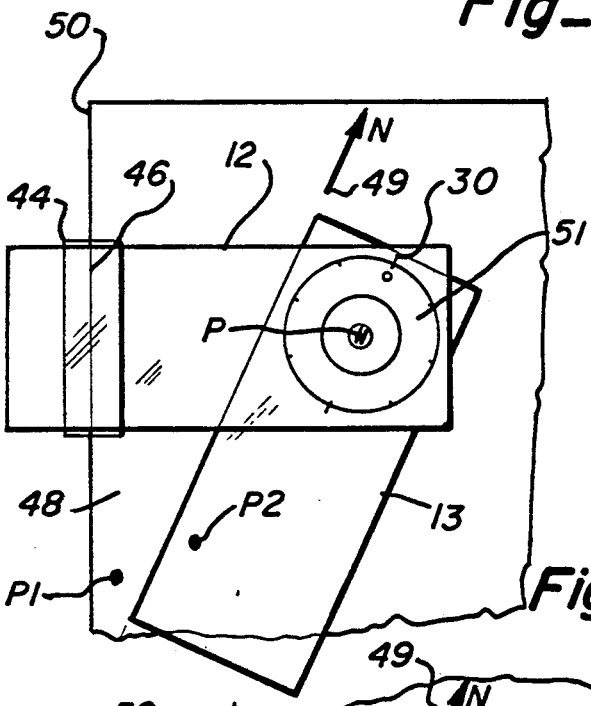
FIG. 8 is a top plan view of an illustration of the calibration operation of the measuring device shown in FIGS. 5–7 to use the photo edge as a reference.

To use the photo edge 50 as the reference, it is necessary to first calibrate the device as is shown in FIG. 8. The bottom arm 13 is positioned parallel to the true north line and the top arm 12 rotated until the distance graduation lines on the top arm (or the sliding cross-hair) are parallel to the photo edge 50. The protractor 51 is then rotated so that the zero on the outer scale is aligned with the top pointer 30 of the corresponding color (red) of the bottom arm.

Figure 8A:
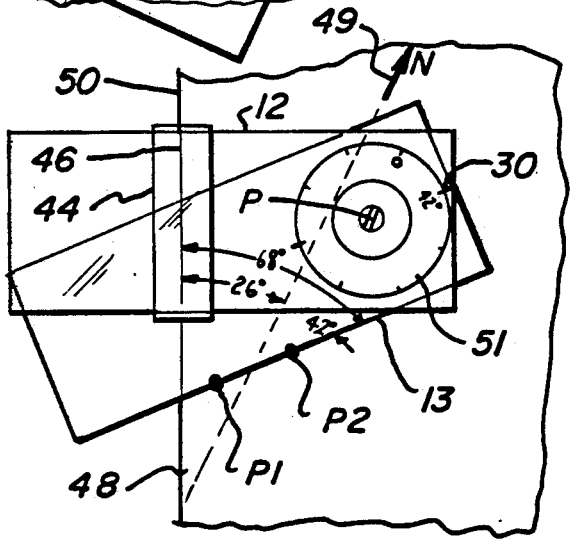
FIG. 8A is a top plan view of an illustration of the operation of the measuring device for measuring distance and angle after calibration.

Referring now to FIG. 8A, to measure the azimuth and distance between points P1 and P2 the bottom arm 13 is positioned so that the appropriate distance scale intersects points P1 and P2 give a measure of distance between these points. The top arm 12 is then rotated until the distance graduations, sliding cross-hair, longitudinal edges, or distance scales are aligned with the photo edge 50. The angle of rotation is read on the protractor. In the illustration shown the angle between true north and a line intersecting points P1 and P2 is 42°. The total angle between the edge and the points is 68° and the angle between the edge and true north is 26°. In this arrangement the full length of the photo edge 50 and the other photo edges may be used as reference lines instead of a relatively short true north arrow 49. When photo edges perpendicular to edge 50 are used as reference lines, pointer marks 32 or 33, which are perpendicular to pointer marks 30 and 31, may be used to show the angle of rotation on the outer scale of the protractor.

Figure 9:
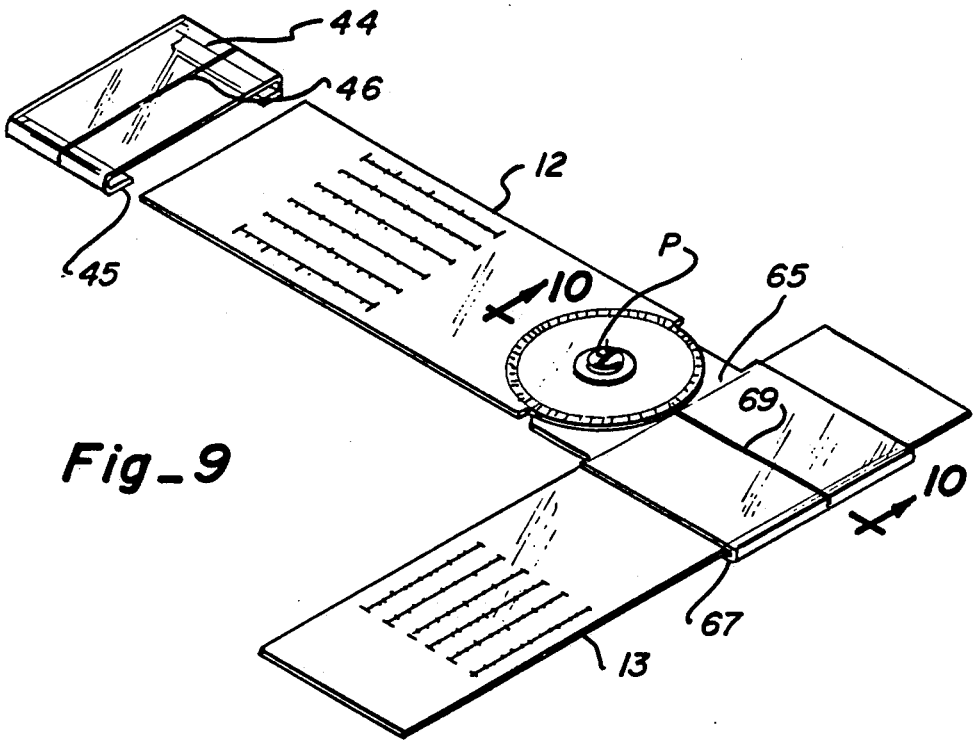
FIG. 9 is a perspective view of yet another embodiment of a topographic measuring device embodying features of the present invention having a third support arm and an offset slidable bottom arm.
Figure 10:
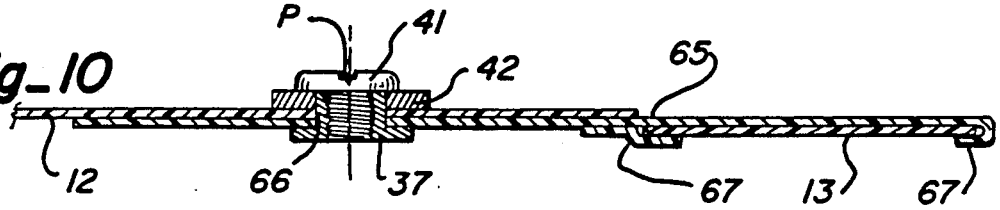
FIG. 10 is a sectional view taken along lines 10—10 of FIG. 9.

Referring now to FIGS. 9 and 10 the measuring device shown has the same top arm 12 and bottom arm 13 as above described. An additional support arm 65 is provided which interconnects with arms 12 and 13. This arm 65 is provided with a hole 66 through which the post 37 extends. Arm 65 has oppositely disposed flanged end portions 67 that cup over around the longitudinal edges of the bottom arm so that the bottom arm will slide therein. A hairline 69 extends perpendicular to the longitudinal side edges and through the pivot P. The colors of the pointer marks on arm 65 are reversed from those of the bottom arm 13. In this arrangement the longitudinal center line of the bottom arm is offset a selected distance from the center of the protractor scale. The operation is the same as that described with respect to FIGS. 1–4 but with the ability of the bottom arm 13 to be shifted relative to the top arm. An advantage of the offset arrangement is that the scales of one arm will not overlap the other, and the distance scales on one arm will not cause wear of the scales on the other arm.

A feature of this construction is that a device of the type shown in FIGS. 1–5 or 5–8 can readily be converted to the type shown in FIGS. 9 and 10 by connecting the top and bottom arms with the support arm 65. It is further understood that the offset construction could be provided by making the support arm 65 integral with the bottom arm in which case the bottom arm 13 would not slide. The bottom arm of a fixed construction design may have to be repositioned (e.g. rotated 180 degrees) so that the pivot point is near enough to the reference line to allow the other (top) arm to reach the reference line. A major advantage of the sliding support arm attachment over the fixed construction is the ability to slide the pivot point (and the top arm) to a position along the bottom arm which allows the top arm to reach the reference line without repositioning the bottom arm. Another advantage of the construction shown in FIG. 9 is the device can be dissembled into three sheets that are narrower than that of having an integral support arm forming the offset.

Although the present invention has been described with a certain degree of particularity, it is understood that the present disclosure has been made by way of example and that changes in details of structure may be made without departing from the spirit thereof.

What is claimed is:

1. A measuring device for topographic sheets having different distance scales comprising:

transparent top and bottom arms pivotally connected together to move relative to one another about a pivot, each of said arms having a pair of longitudinal edges, a plurality of different distance scales extending along each of said arms, each of said distance scales extending parallel to the longitudinal edges of the associated arm and having a series of spaced graduation lines arranged perpendicular to the longitudinal edges of the associated arm, said top arm carrying a protractor with a center, said protractor having a protractor line with 0 to 180 indicia, said bottom arm having pointer means adjacent and operatively associated with said protractor, said pointer means being offset 90 degrees on the bottom arm with respect to the orientation of said protractor line on said top arm when said top and bottom arms are superposed on one another, one of said distance scales on one of said arms being used to measure the distance between two selected points on a selected one of said topographic sheets by the placement of said one distance scale for that sheet so that both of said points intersect said selected distance scale, the other of said arms being rotated until a selected line associated with said other arm is parallel to a reference line to provide an indication of the angle formed by said one distance scale with said reference line and readable on said protractor.

2. A measuring device as set forth in claim 1 wherein said selected line is one of said distance scale graduation lines and in the alternative is a cross-hair on a member slidable on one of said arms.

3. A measuring device as set forth in claim 1 wherein selected of said graduation lines for different scales on each arm are in alignment for alignment with said reference line on said selected one topographic sheet.

4. A measuring device as set forth in claim 1 wherein selected graduation lines of the scales adjacent each of said longitudinal edges are longer than the other graduation lines to provide a pair of lines for aligning equidistant from said reference line on said selected one topographic sheet.

5. A measuring device as set forth in claim 1 wherein said graduation lines on each arm have a series of succeeding scale ratios.

6. A measuring device as set forth in claim 1 wherein each said distance scale has numerical indicia to indicate distance for its respective scale.

7. A measuring device as set forth in claim 6 wherein there are two sets of numerical indicia for each distance scale with one set being inverted relative to the other.

8. A measuring device as set forth in claim 1 wherein each of said arms are in the form of an elongated, rectangular, thin, flat, flexible sheet of a plastic material.

9. A measuring device as set forth in claim 1 wherein said longitudinal edges of said top arm are perpendicular to a north-south axis of a scale of said protractor.

10. A measuring device as set forth in claim 1 wherein said protractor has graduation lines extending radially from said center and having an outer scale with numerical indicia from 0 to 360 associated with said lines proceeding in a clockwise direction and an inner scale with numerical indicia from 0 to 360 associated with said lines proceeding in a counterclockwise direction.

11. A measuring device as set forth in claim 10 wherein the 0 for said outer scale is located at the top of the top arm with the top arm oriented so that the associated distance scales extend to the left away from the protractor and the 0 for the inner scale is on the left side which corresponds to the 270° position for the outer scale.

12. A measuring device as set forth in claim 10 wherein the numerical indicia for the outer scale is arranged to extend circumferentially and the numerical indicia for the inner scale is arranged to extend radially.

13. A measuring device as set forth in claim 10 wherein said pointer means includes a first set of oppositely disposed pointer marks on the longitudinal center line of said bottom arm operatively associated with said outer scale and a second set of oppositely disposed pointer marks at right angles to said first set and operatively associated with said inner scale.

14. A measuring device as set forth in claim 13 wherein said outer scale and first set of pointer marks are of the same color and said inner scale and second set of pointer marks are of the same color.

15. A measuring device as set forth in claim 1 wherein the longitudinal center lines of said top and bottom arms intersect at said center of said protractor scale.

16. A measuring device as set forth in claim 1 wherein said protractor is affixed to said top arm.

17. A measuring device as set forth in claim 1 where said top arm has a circular hub affixed thereto, said protractor being concentric with and rotatable about said hub relative to said top arm and removable from said top arm for changing protractors and further including means to prevent said protractor from rotating when said bottom arm is rotated relative to said top arm.

18. A measuring device as set forth in claim 17 wherein said means to prevent includes a first edge on said top arm that engages a second edge on a hold down washer securing said top and bottom arms for rotation relative to one another.

19. A measuring device as set forth in claim 17 wherein said protractor is in the form of a thin flat ring.

20. A measuring device as set forth in claim 19 wherein said pivotal connection between said arms is provided by aligned holes in said arms through which a screw post having a flat head and internal threads extends and a flat-headed screw with a washer that threads into said screw post.

21. A measuring device as set forth in claim 1 further including a slidable cross-hair member having flanged end portions that cup over and slide along the longitudinal edges of either of said arms, said member having a cross-hair that is arranged parallel to associated distance graduation lines on the arm on which said member is slidably mounted.

22. A measuring device as set forth in claim 1 wherein the longitudinal center line of said top arm intersects at the center of said protractor and the longitudinal center line of said bottom arm is offset a selected distance from the center of said protractor scale.

23. A measuring device as set forth in claim 22 wherein said bottom arm is slidable in either direction along a line parallel to the longitudinal center line of said bottom arm.

24. A measuring device as set forth in claim 23 including a support arm mounted to pivot relative to said top arm about said pivoted connection at said pivot of said top and bottom arm and having a pair of opposite flanged end portions spaced a selected distance from said pivot in which said bottom arm is slidably supported.

25. A measuring device as set forth in claim 24 wherein said support arm is transparent and has a cross-hair for aligning with the distance graduation lines on said bottom arm.

26. A measuring device as set forth in claim 24 wherein said top and bottom arm and said support arm are removably held together by a screw post and a screw that forms said pivotal connection for ready assembly and disassembly.

27. A measuring device as set forth in claim 1 wherein selected graduation lines of the top and bottom of said distance scales extend to the longitudinal edges of the arm and serve as plotting marks.

28. A measuring device for topographic sheets having different distance scales comprising:

transparent top and bottom arms pivotally connected together to move relative to one another about a pivot, a plurality of different distance scales extending along each of said arms, each of said distance scales extending parallel to the longitudinal edges of the associated arm and having a series of spaced graduation lines arranged perpendicular to the longitudinal edges of the associated arm, said top arm carrying a protractor with a center, said protractor being in the form of a thin, flat ring, said top arm having a circular hub affixed thereto, said protractor being concentric with and rotatable about said hub relative to said top arm and removable from said top arm for changing protractors and further including means to prevent said protractor from rotating when said bottom arm is rotated relative to said top arm, said protractor having a protractor line with 0 and 180 indicia, a slidable cross-hair member slidably mounted on said top arm that aligns with an edge of a selected one of said topographic sheets having a true north line, said bottom arm having pointer means adjacent and operatively associated with said protractor, said pointer means being offset 90 degrees on the bottom arm with respect to the orientation of said protractor line on said top arm when said top and bottom arms are superposed on one another, said bottom arm being positioned parallel to the true north line and said top arm being rotated so that the 0 on the protractor is aligned with the pointer means on the bottom arm, said bottom arm being positioned so that one of said distance scales on said bottom arm intersects two selected points on a selected one of said topographic sheets to give a measure of the distance between said two points and said top arm is rotated until a selected line associated with said bottom arm is parallel to an edge of one of the topographic sheets to provide an indication of the angle formed by said one distance scale with said reference line and readable on said protractor whereby the measurement may be made by using said edge of said one of said topographic sheets as the reference.

* * * * *